US007134736B2

(12) United States Patent
Merz et al.

(10) Patent No.: US 7,134,736 B2
(45) Date of Patent: Nov. 14, 2006

(54) PRINTER WITH PRINTHEAD FULLY TRAVELING AROUND DRIVE BELT LOOP

(75) Inventors: Eric A. Merz, Palmyra, NY (US); Brian S. Hilton, Penfield, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 10/752,721

(22) Filed: Jan. 8, 2004

(65) Prior Publication Data

US 2005/0151768 A1 Jul. 14, 2005

(51) Int. Cl.
*B41J 29/38* (2006.01)

(52) U.S. Cl. ..... 347/5; 347/37; 347/38

(58) Field of Classification Search ..... 347/37, 347/38, 5

See application file for complete search history.

(56) References Cited

U.S. PATENT DOCUMENTS 4,804,285 A 2/1989 Bradford
4,980,009 A * 12/1990 Goodwin et al. ..... 156/249
5,129,746 A * 7/1992 Epstein ..... 400/323
5,276,970 A 1/1994 Wilcox et al.
5,456,539 A 10/1995 Wright et al.
5,670,995 A * 9/1997 Kupcho et al. ..... 347/5
6,123,473 A 9/2000 Guillen et al.
6,264,298 B1 7/2001 Mantel
6,290,351 B1 9/2001 Merz
6,325,503 B1 * 12/2001 McCue et al. ..... 347/101
6,341,839 B1 * 1/2002 Burikov et al. ..... 347/37
2003/0227511 A1 * 12/2003 Menendez et al. ..... 347/37

* cited by examiner

*Primary Examiner*—Manish S. Shah
*Assistant Examiner*—Laura E. Martin
(74) *Attorney, Agent, or Firm*—Oliff & Berridge, PLC

(57) ABSTRACT

A drive assembly for a printer includes an endless loop drive path and guide structure that allows a printhead to operate in either reciprocal or endless loop modes in which the printed traverse both a liner and an arcuate portion of the drive path. This provides a printer architecture in which a printhead may be endlessly driven at a constant speed in one direction to provide multiple print swaths separated spatially. This eliminates the need for deceleration/acceleration changes required in reciprocal printer architectures and is capable of increased throughput by defining arcuate turnaround zones that can be traversed by the printhead faster than the time it takes to slow, stop and reverse a conventional reciprocal printhead assembly. This robust printer architecture also allows flexibility in use of multiple printheads with simultaneous printing, simultaneous both side printing, and duplex capabilities.

21 Claims, 9 Drawing Sheets

PRINTER WITH PRINTHEAD FULLY TRAVELING AROUND DRIVE BELT LOOP

BACKGROUND OF THE INVENTION

1. Field of Invention

This invention is directed to a printer architecture in which the printhead carriage assembly is attachably supported to an endless drive belt so as to be driven around a radius of the belt, preferably in endless loop fashion.

2. Description of Related Art

In known printing and typing machines, a printhead is traversed across a recording medium, such as paper, in a reciprocating (back-and-forth) fashion by means of a carriage transport apparatus consisting of drive belts, lead screws, wires and/or other devices. The printhead may then further be constrained for linear movement along a printing axis by various support devices, such as tracks, sliders and carriage guide rods. For processing reasons, current architectures scan a printhead across a print zone at a constant speed. However, once the edge of the print zone is reached, the printhead must be stopped and accelerated in an opposite direction back to the constant speed prior to the print zone to continue printing. As such, these printing architectures require a non-print slow down zone at each lateral end of the printer.

A typical conventional printer with such a reciprocating carriage assembly is illustrated in FIG. 1 in which a printer, such as illustrated ink jet printer 100, includes an ink jet printhead cartridge 110 mounted on carriage 120 supported by carriage rails 130. The printhead cartridge 110 contains a housing containing ink and expels the ink through various ejector nozzles 112 under control of electrical signals received from a controller/CPU 140.

When printing, the carriage 120 reciprocates back and forth along carriage rails 130 in the direction of arrow FS. This movement is achieved by a reciprocating drive assembly 150. Reciprocating drive assembly 150 typically consists of an endless belt 152 rotatably mounted on a drive roller 154 and an idler roller 156. Drive roller 154 is driven by a reversible motor 158, such as a servo motor, under control of controller/CPU 140. Since printhead carriage 120 is fixed to the endless belt 152, carriage 120 housing printhead cartridge 110 follows the reciprocating path of endless belt 152 while being linearly guided by carriage rails 130. Proper positioning of the printhead and carriage is maintained by a conventional encoder system, such as a linear encoder consisting of an optical sensor 160 and a linear encoder fence or strip 162 mounted in scan direction FS. As the carriage is moved, the sensor 160 senses the passages of evenly spaced, alternating light and dark areas on the strip, which are used to compute travel distance and relative location as is known.

As the printhead cartridge 110 is traversed back and forth across the print zone, droplets of ink are expelled from select nozzles 112. During each pass, substrate P is maintained fixed. This provides a band or swath of print of a height H corresponding to the height of the printhead nozzle array. For purposes of print control, the reciprocation motion through a print zone laterally defined by substrate P is at a constant speed.

At the end of each pass or upon completion of multiple passes when in a multiple pass mode, the substrate P is advanced in a paper advance direction substantially perpendicular to the scanning direction FS.

There are many practical limits to the printing speed of such a conventional print engine architecture. Even as the firing frequency and number of nozzles in an ink jet printer have increased, carriage motion and paper handling have become major limiting factors in printer throughput. Reciprocating printing by back and forth movement of the print carriage at higher speeds has diminishing returns in throughput because increased carriage velocity requires increased travel distances at the ends of the reciprocating path to slow, stop, and reaccelerate the carriage to a desired constant printing speed. That is, this conventional architecture requires additional travel lengths L on both ends of the print zone in order to accelerate the carriage from a stop position to the desired constant speed before the beginning of the print zone, and to allow a deceleration zone at the end of the print zone in which to slow the carriage to a full stop, reverse direction, and reaccelerate the carriage to the desired constant speed before the carriage reaches the print zone in a reverse pass.

As the constant print speed increases, this extra travel distance L must be increased to fully slow or accelerate the carriage from higher speed, or requires substantially higher g-forces and loads on the carriage, drive motors and other printer components to achieve increased acceleration/deceleration rates. However, because there are practical limits to the g-forces sustainable by such components, typically around 1–2 g, the extra print speed typically equates to a longer travel path L. The longer travel path L makes the width of the printer housing longer, i.e., increases its footprint, and requires additional non-print time to achieve the reciprocal movement. Moreover, higher terminal velocities and acceleration/deceleration rates have adverse effects on the reliability and accuracy of carriage components.

For example, assume that a conventional printer for printing an 8"×10" print zone (roughly the printable size on a standard 8.5"×11" paper) uses a 1" printhead array (i.e., prints with a 1" print swath) to print at a constant scan speed of 45 inches/second (ips) with a typical 1 g acceleration/deceleration profile at the beginning/end of each pass. To print a full sheet of paper would require 10 passes in single pass mode.

This conventional architecture requires the moving printhead carriage to stop and reverse its direction. Assuming a constant acceleration of $v=v_0+a(t)$, stopping from 45 ips and returning to 45 ips in the opposite direction equates to $$45\text{ ips}=-45\text{ ips}+(1\text{ g}=9.81\text{ m/s}^2)(t).$$

Solving this results in a total time t=0.233 seconds for the complete deceleration/acceleration cycle in the non-print zone.

The standard configuration for print zone overtravel is $$s=s_0+v_0t+0.5\text{ at}^2.$$

Solving this for the above example is s=0+45 ips (0.1165 sec)+0.5(9.81 m/s$^2$)(0.1165)$^2$=2.62 inches. Therefore, in this exemplary conventional architecture, a theoretical non-printing zone of a length L of at least 2.62 inches is necessary at each end of the travel path to accommodate the deceleration/acceleration.

Prior attempts to further increase throughput have focused on increased carriage/printhead size. For example, it is known to provide full paper width printhead arrays that do not reciprocate. Rather, a recording medium is linearly advanced past the fullwidth array to print at high throughput. However, fullwidth arrays are expensive. Bigger printhead size also has its limitations. Although this allows more effective printing area coverage per swath, the extra weight and size are counterproductive to increased printing carriage motion, since the added weight affects the forces acting on the carriage. As such, there are practical limitations to the speed at which such an increased printhead can be reciprocated. Moreover, as mentioned above, minor increases in printing speed across the print zone may be offset by necessitated increased non-print time in the non-print zones.

SUMMARY OF THE INVENTION

There is a need for an improved printer architecture that is capable of increased throughput.

There is further a need for a printer architecture that does not induce the stresses on printer driving mechanism components associated with reciprocal motion and the need for rapid acceleration/deceleration profiles.

There is further a need for a printer architecture that can provide multiple pass printing without substantially decreasing throughput.

Aspects of this invention provide an improved printer architecture that is capable of increased throughput.

Aspects of this invention separately provide an improved printer architecture that is capable of reducing the footprint size of the printer through reduction of lateral non-print zones.

In various exemplary embodiments, systems, device and methods of this invention, a printer architecture achieves a non-linear print path at least in a non-print zone by traversing over an arcuate portion of the drive system path.

Aspects of this invention also separately provide an improved printer architecture that can provide multiple pass printing without the typical reduced printer throughput.

Aspects of this invention also separately provide a printer architecture that can provide two-sided printing with increased throughput.

In various exemplary embodiments, aspects of this invention further separately provides a printer architecture that can achieve printing with a single direction drive motor.

In various exemplary embodiments of the systems, methods and structures of the invention, a printer architecture can print multiple consecutive print swath passes while maintaining a substantially constant printhead velocity.

In various other exemplary embodiments, this invention further separately provides a printer architecture, printing method and system that can accommodate printing of offset print swaths in consecutive print passes.

In various other exemplary embodiments, this invention further separately provides a printer architecture capable of operating in an endless loop mode. In other various exemplary embodiments, the printer architecture may operate in either or both of reciprocal and endless loop modes.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

The following detailed description of various exemplary embodiments of a printer architecture and printing methods may refer to specific printer types, such as ink jet printers, for sake of clarity and familiarity. However, it should be appreciated that the principles of this invention, as outlined and/or discussed below, can be equally applied to any known or later-developed printer or marking system beyond the specific exemplary architectures and printers discussed herein.

Figure 2:
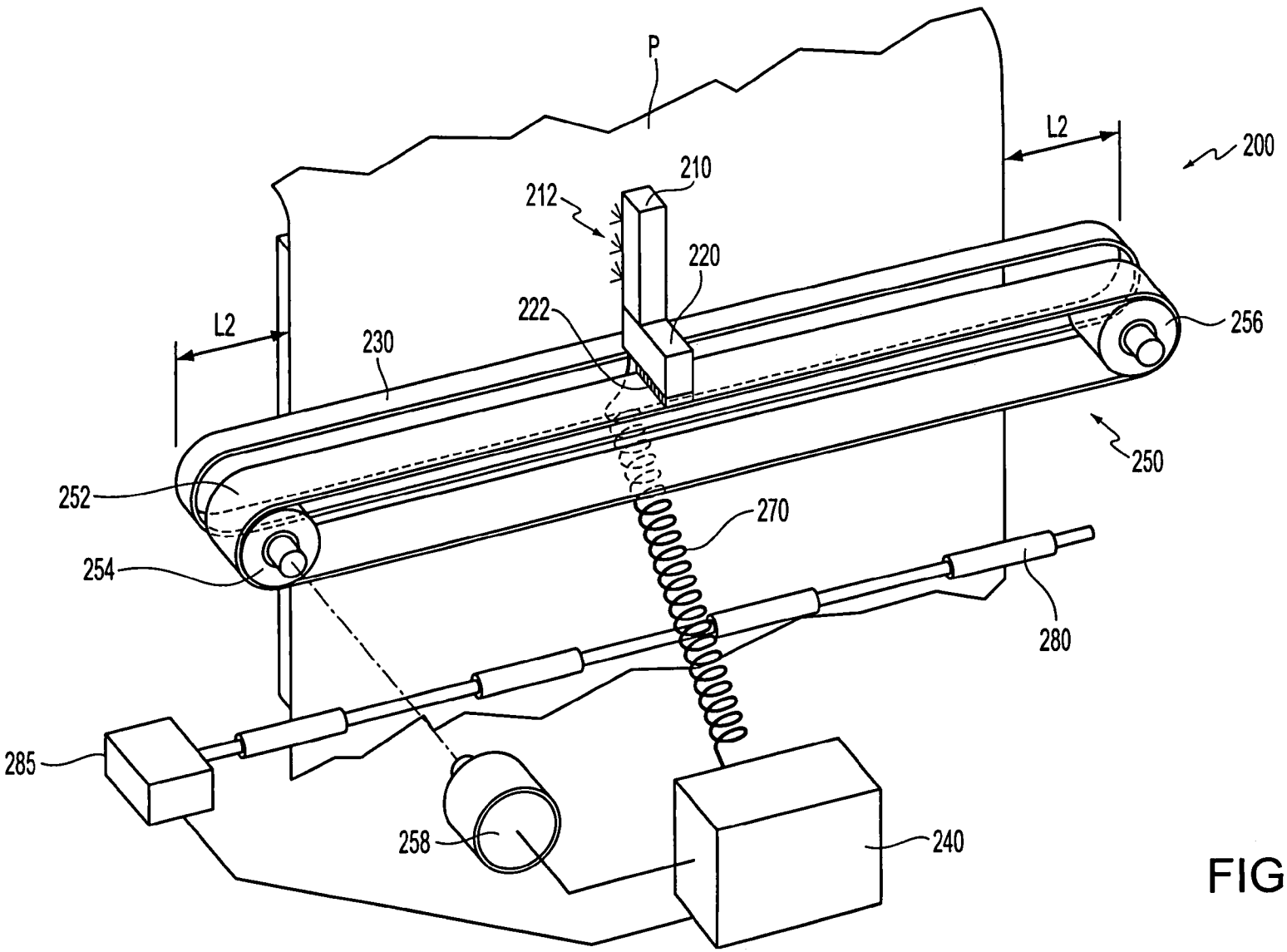
FIG. 2 shows an exemplary embodiment of a printer architecture having an endless printhead path and a first exemplary printhead guide system according to the invention.

FIG. 2 shows a printer architecture usable with the printing systems, methods and structures of this invention. As shown, a printer 200, such as the illustrated ink jet printer, includes an ink jet printhead cartridge 210 mounted on carriage 220 supported by a carriage support member 230. The printhead cartridge 210 contains a housing containing ink and expels the ink through various ejector nozzles 212 under control of electrical signals received from a controller/CPU 240.

Movement of carriage 210 is achieved by drive assembly 250. Whereas prior art drive assemblies required and allowed only reciprocating movement along a linear print path in the fast scan direction FS, the inventive drive assembly is not limited by reciprocal movement. Rather, by providing carriage attachment and support structures as discussed in greater detail below, the inventive drive assembly may transport carriage 220 with either reciprocal or endless path motion that substantially tracks an endless belt loop drive mechanism of drive assembly 250. By doing so, the versatility of the printer architecture is substantially enhanced. In various embodiments, combined movements are achievable in which the printhead carriage 220 is driven reciprocally, but traverses across at least a portion of the arcuate path of the endless belt path.

Drive assembly 250 in a first exemplary embodiment includes an endless belt drive loop 252 rotatably mounted on drive roller 254 and idler roller 256. Drive roller 254 is driven by a suitable drive source 258, such as a stepper or servo motor suitably controlled by CPU/controller 240. Printhead carriage 210 is fixedly attached to endless drive belt 252 for movement therewith by suitable attachments. However, rather than limiting movement to linear reciprocal movement, the printhead carriage 220 is mounted and constrained by flexible attachment members 222 so as to be rotatable about the drive roller 254 and idler roller 256. For example, attachment members 222 may be hinged, pivotal, flexible or thinly shaped and sized to accommodate movement around drive rollers 254 and 256. As such, printhead cartridge 210 and printhead carriage 220 are movable in an oval pattern, one that at least traverses over a linear portion of the path and an arcuate portion of the path.

In exemplary embodiments of the methods, systems and structures of the invention, movement of the carriage 220 follows an endless loop path. In various embodiments, this endless path may be traversed with movement in a same clockwise or counterclockwise direction with respect to the belt loop 252. However, this architecture makes it equally possible to also provide reciprocal motion in certain modes of operation, and provide a reversal of endless loop path direction when a reversible drive motor is used. In exemplary embodiments, the printhead traverses at least one-half of the length of the endless loop path so that it traverses both a linear portion of the path (which contains a print zone) and a non-linear arcuate portion of the path (which serves as a non-print turnaround zone).

To assist in positioning of the carriage and printhead assembly 210, 220, it is desirable to provide carriage support device 230. The form and structure of carriage support device can take many forms, so long as it achieves sufficient control of the position of the printhead 210 at least while the printhead traverses through a print zone.

Since printhead carriage 220 is fixed to the endless belt 252 by suitable flexible attachment members 222, carriage 220 housing printhead cartridge 210 substantially follows the path of endless belt 252. However, since it is not supported by linear carriage rails as in the prior art, carriage 220 is capable of traversal over arcuate portions of the endless loop path of belt 252, and even full traversal of the endless path. As such, it is capable of operating in either conventional reciprocal or novel endless loop mode travel or combinations of both.

Figure 1:
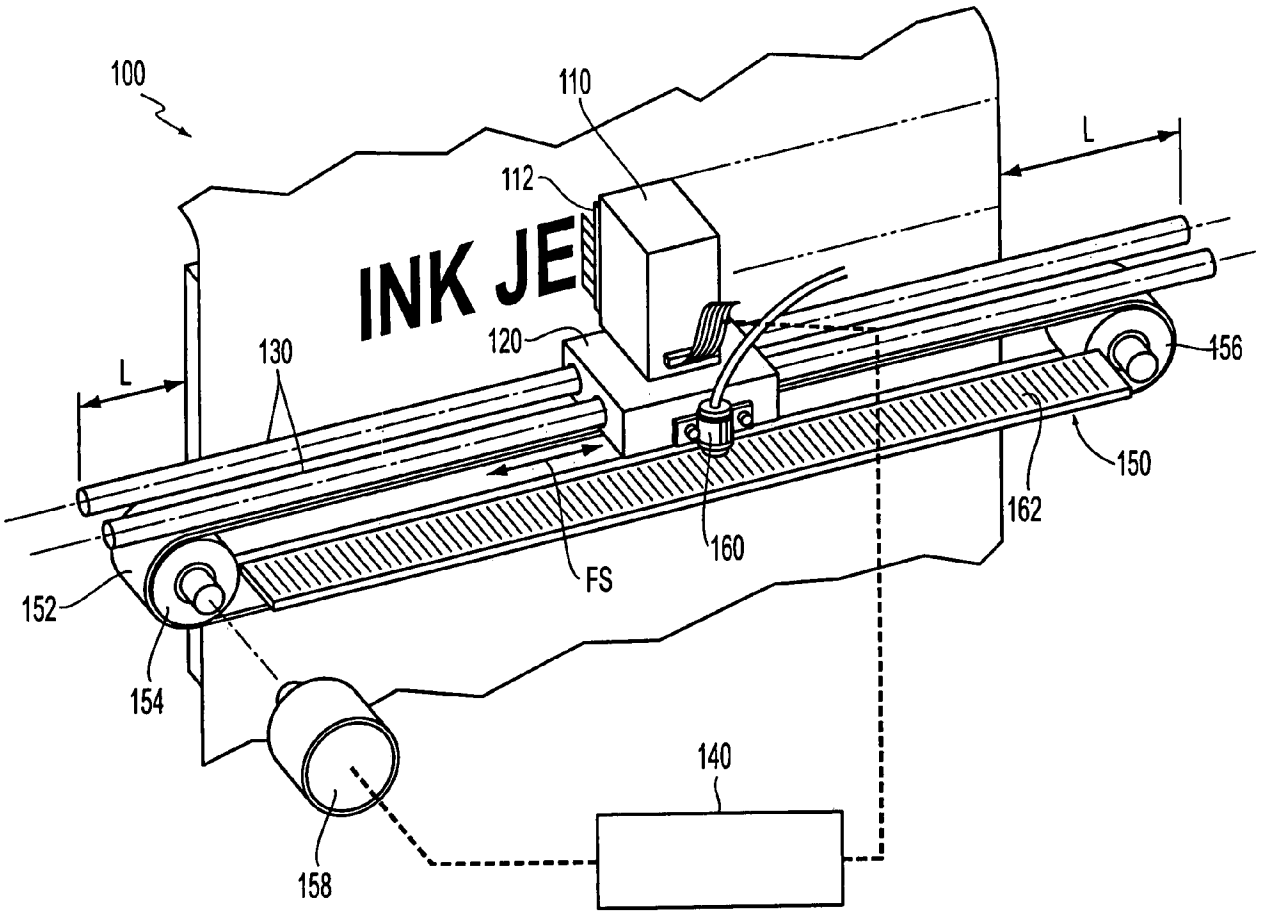
FIG. 1 PRIOR ART
FIG. 1 shows a conventional reciprocating printer architecture.

Proper positioning of the printhead and carriage may be maintained by a conventional encoder system, such as the linear encoder system (unshown) described in FIG. 1. However, other positioning systems can be used, such as a rotary encoder provided on the shaft of drive roller 254 to control and sense at least relative positioning of printhead 210. As the carriage is moved, the sensor 160 senses the passages of evenly spaced, alternating light and dark areas on the strip, which are used to compute travel distance and relative location as is known.

As the printhead cartridge 110 is advanced across the print zone, droplets of ink are expelled from select nozzles 112. During each pass, substrate P is maintained fixed. This provides a band or swath of print of a height H corresponding to the height of the printhead nozzle array. For purposes of print control, the motion through a print zone laterally defined by substrate P, is preferably at a constant speed. However, other velocity and acceleration profiles may be used.

At the end of the print zone, usually typified by the width of paper P, lateral non-print zones of length L2 are provided. In the conventional reciprocal architecture of FIG. 1, these non-print areas were provided as deceleration/acceleration zones where the printhead was slowed, stopped, and reversed direction. In various exemplary embodiments of the invention, such non-print zones form turnaround zones about which the printhead carriage 220 is constrained to rotate to reverse the direction of the printhead 210 without the need to slow down or reverse direction. This allows a much simpler control logic to be used in which the velocity of the printhead once accelerated to print speed can be maintained throughout substantial portions of the printing process. Preferably, endless belt rollers 254 and 256 are provided with a centerline substantially at the edge adjacent the print zone. This minimizes the non-print turnaround zone, effectively making it correspond the one-half the circumference of the drive roller ($\pi R$, where R is the radius of the drive roller).

At the end of each pass or upon completion of multiple passes when in a multiple pass mode, the substrate P is advanced in a paper advance direction substantially perpendicular to the scanning direction FS. This may be accomplished by rollers 280, which serve as an indexing mechanism, driven by drive motor 285 as is known in the art. This paper indexing is thus preferably timed to occur while the printhead is in the turnaround zone.

To accommodate endless loop (oval) or reciprocal motion in either clockwise or counterclockwise directions, printhead cartridge. 210 may be electrically connected to a power source through a flexible coupling 270. One suitable non-limiting example is a coiled wiring arrangement capable of extension and retraction, as well as rotational twisting to conform to movement paths of the printhead without getting tangled. Many other suitable electrical connections can be substituted, for example rotational couplings such as slip rings, induction, etc.

To reduce overall size and weight of the printhead, a refillable cartridge may be used with a fluid docking and refill station as known in the art. This reduces the mass of the printhead assembly, which reduces forces acting on the drive assembly components, which allows smaller drive components. Moreover, since acceleration properties are not as critical as in a reciprocal drive assembly, less expensive drive components can be used that have lesser torque and acceleration profiles.

As discussed above with reference to the conventional art of FIG. 1, there is a limit to throughput efficiency, since the non-print zone dwell time is a substantial component of the total time needed to print a given page, often expressed in pages per minute of throughput. Given the hypothetical example of FIG. 1 with a conventional reciprocal path, an 8"×10" print zone with 1" swaths takes 10 passes in single pass mode, with 10 turnaround times to reverse direction. This standard configuration with a 45 ips print velocity requires 0.233 seconds to slow down and return to the print zone in the opposite direction. Thus, total print time is: $10(8/45)+10(0.233)=4.1$ seconds for the conventional architecture. This equates to 14.6 ppm.

However, using the exemplary endless loop printing architecture, there is no need for slow down and/or reversal. Instead, constant velocity can be maintained. This makes the control easier, and results in less wear and stress on various drive components, such as the belt, drive teeth, guides, sliders, etc. Alternatively, speed could be increased in the non-print zone.

Given the same print zone velocity of 45 ips, a 1" print swath, and an exemplary 1" (25.4 mm) drive roller radius, the non-print time (time from the end of print zone, travel around the turnaround zone of the roller by the printhead, and return to the print zone) generally corresponds to travel around one-half the circumference of the roller when the roller is positioned substantially at the end of the print zone. With this 1" radius, this corresponds to a turnaround time (non-print time) $t=(n/2)(1")/45=0.035$ seconds. Thus, total time to print this 8"×10" print zone$=10(8/45)+10(0.035)=2.13$ seconds. This equates to 28.2 ppm, or nearly twice as fast as the conventional reciprocal printer which prints at 14.6 ppm for the same given print velocity.

From this, it is clear that great improvement in total throughput can be achieved without even changing the speed of the printing velocity when the printer architecture includes this novel new printing methodology. That is, provision of a suitably sized turnaround zone may achieve substantially improved total throughput, without the need to increase printing velocity or printhead size. Moreover, because deceleration/acceleration profiles are not cycled through repeatedly, it is believed that forces acting on the various drive components can be less, resulting in improved reliability and durability.

A smaller radii roller will equate to a quicker turnaround time, since the circumference defines the path length of the turnaround zone. However, the smaller the radii, the higher the inertia and g-force loads acting on the printhead when traveling around the radius. Because of this and the possible complexities of turning around the printhead carriage assembly on a very small roller while maintaining suitable positional and frictional criteria, there are practical limits on the minimum roller diameter.

Suitable radii R should not go much below 15–20 mm, and preferably should be at least 25 mm to achieve desirable results. Increases above 25 mm will reduce forces acting upon the printhead carriage assembly, but result in increased non-print pendency. As such, design constraints of the printer, including desired total throughput, may define suitable upper boundaries to the drive and idler roller diameters used. A suitable contemplated range is 15–50 mm, preferably 25–33 mm.

In view of the theoretical throughput speeds attainable with this printer architecture, it may be necessary to improve paper index mechanisms to accommodate the reduce pendency in non-print times. That is, because the time between passes is reduced, the speed of paper indexing may need to be increased to achieve full indexing before the next pass begins. This may be possible through substitution of known servo motor technology instead of slower stepper drive systems, which are typically used in many printer applications.

As with the linear guide rods 130 in FIG. 1, the oval carriage support device 230 is provided to constrain movement of printhead carriage 220 and printhead 210 so as to precisely guide alignment of the printhead 210, as least as it travels through the print zone. This is because at least in the case of endless belt drive systems, belts are capable of stretching. Carriage support device 230 may be formed as a rigid fixed material, such as a metal guide rod that conforms in shape to the path of the endless belt. Constraint of the carriage 220 to device 230 may be through a low-friction slider mechanism, such as a pair of opposed guide wheels affixed to printhead carriage 220 that allow translation along the support device 230, but maintain tight tolerances in other axes. Alternatively, a roller of the size of the spacing between rails may be provided on the inner surface to allow suitable controlled movement of the printhead around arcuate portions of the endless belt path. However, other constructions are possible.

Figure 3A:
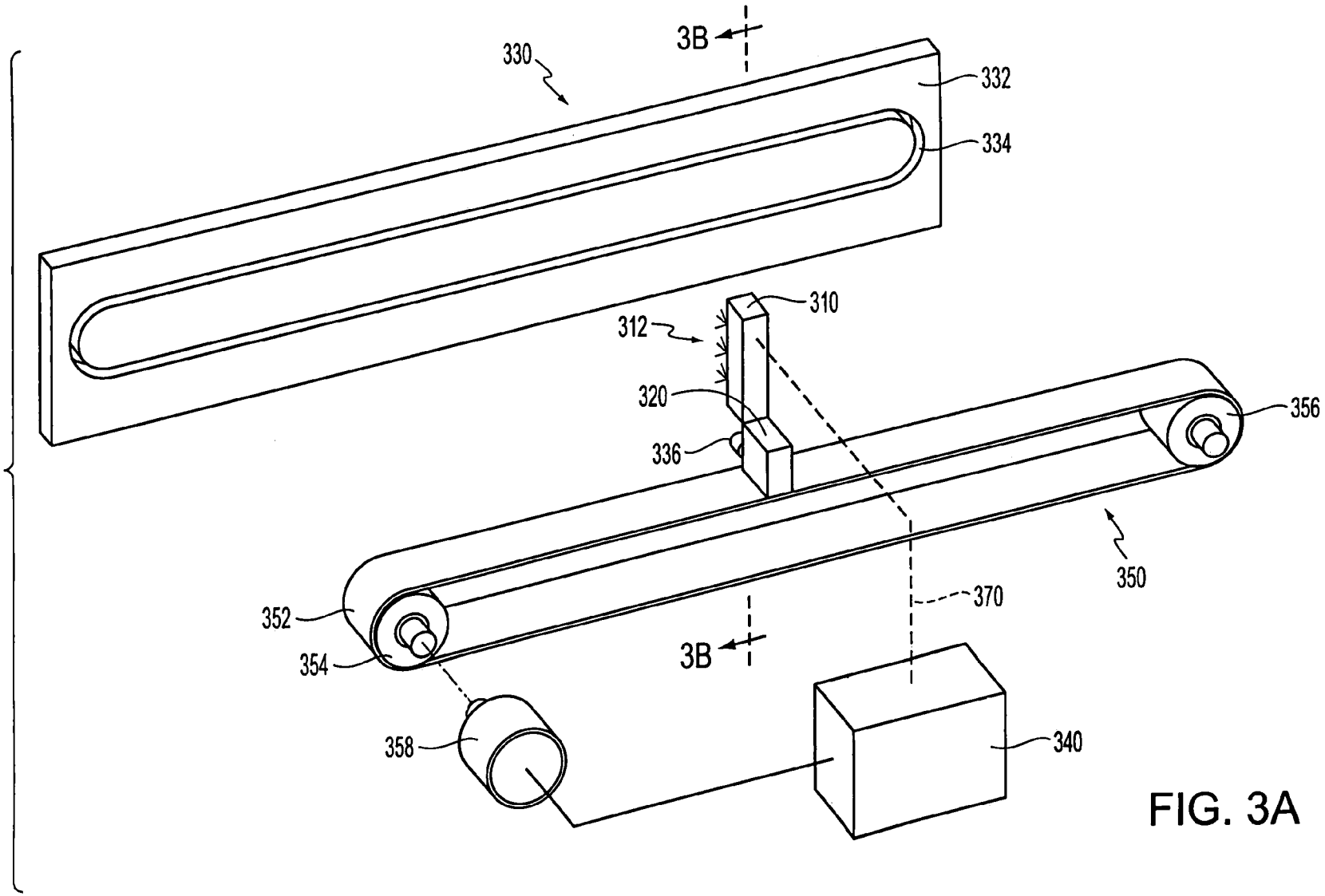
FIGS. 3A–B show an exemplary embodiment of a printer architecture having an endless printhead path and a second exemplary printhead guide system according to the invention.
Figure 3B:
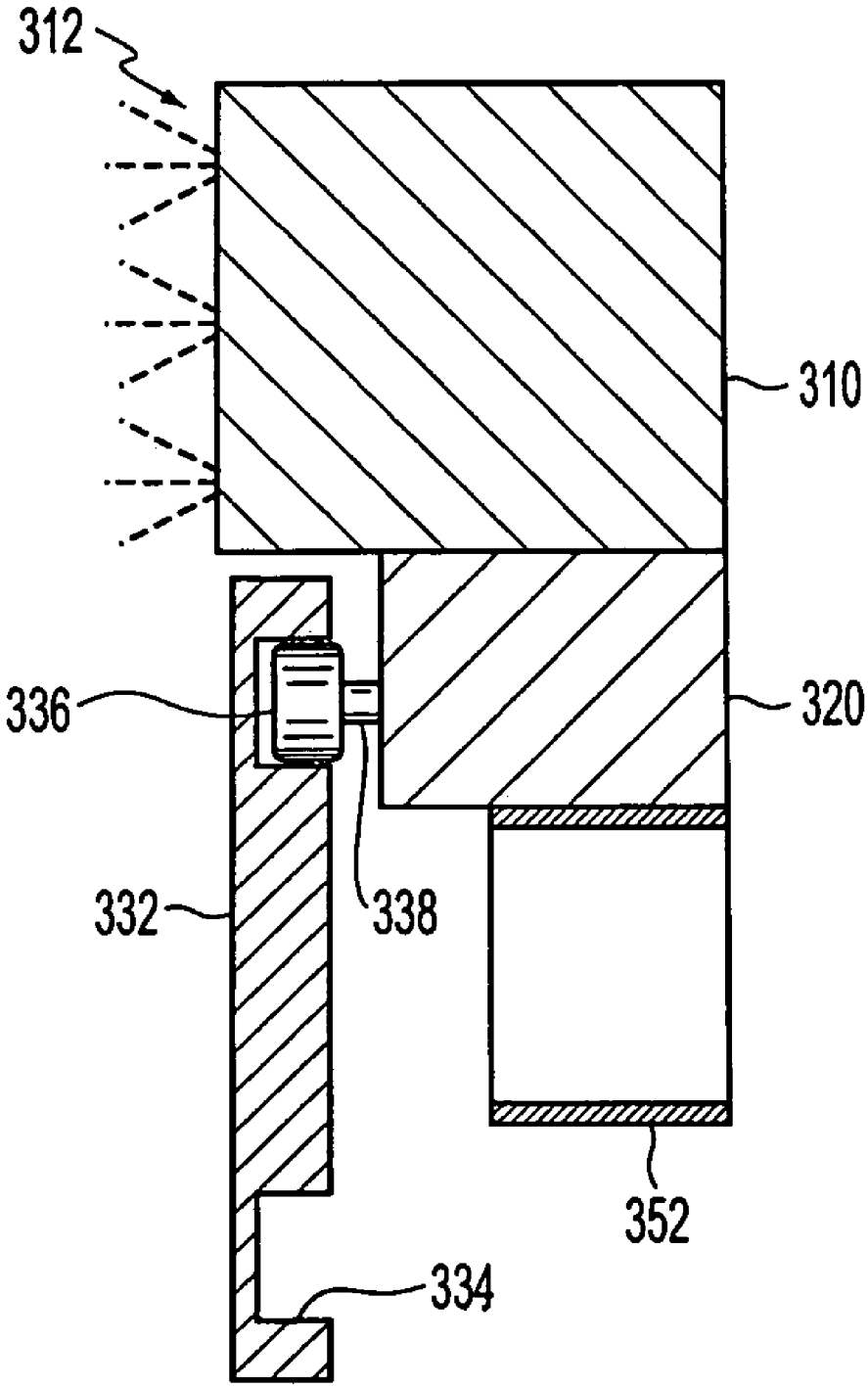

FIGS. 3A–B show an alternative embodiment of an endless printhead architecture with a second-exemplary printhead guide system according to the invention. In this embodiment, a drive assembly 350 includes an endless belt loop 352 rotatably mounted on drive roller 354 and idler roller 356. Drive roller 354 is driven by a suitable drive source 358, such as a stepper or servo motor suitably controlled by CPU/controller 340. Printhead carriage 320 is fixedly attached to endless drive belt 352 for movement therewith by suitable attachments. However, rather than limiting movement to linear reciprocal movement, the printhead carriage 320 is mounted and constrained so as to be rotatable about the drive roller 354 and idler roller 356. As such, printhead carriage 320 and printhead 310 are movable in an oval pattern.

This embodiment differs from the previous embodiment primarily in use of an alternative printhead guide system. As with the linear guide rods 130 in FIG. 1, an oval carriage support device 330 is provided to constrain movement of printhead carriage 320 and printhead 310 so as to precisely guide alignment of the printhead 310, as least as it travels through the print zone. Carriage guide device 330 includes a base member 332 and a recessed guide path 334 sized to correspond to the endless path of the endless belt 352 and shaped to receive a mating member 336 provided on printhead carriage 320. Mating member 336 can take many forms. If the coefficient of friction is sufficiently small, it may be a fixed, non-rotating element. This may be achieved by making one or both contact surfaces of a low-friction material such as Teflon or ceramic. However, it could also be formed by a rolling element mounted on a shaft 338 and sized and shaped to fit within guide path 334. Constraint is this embodiment is achieved by the combination of tolerances of guide path 334 and mating member 336. Base member 332 is suitably positioned a fixed distance from mating element 336 so that the mating element retains contact with guide path 334.

Figure 4:
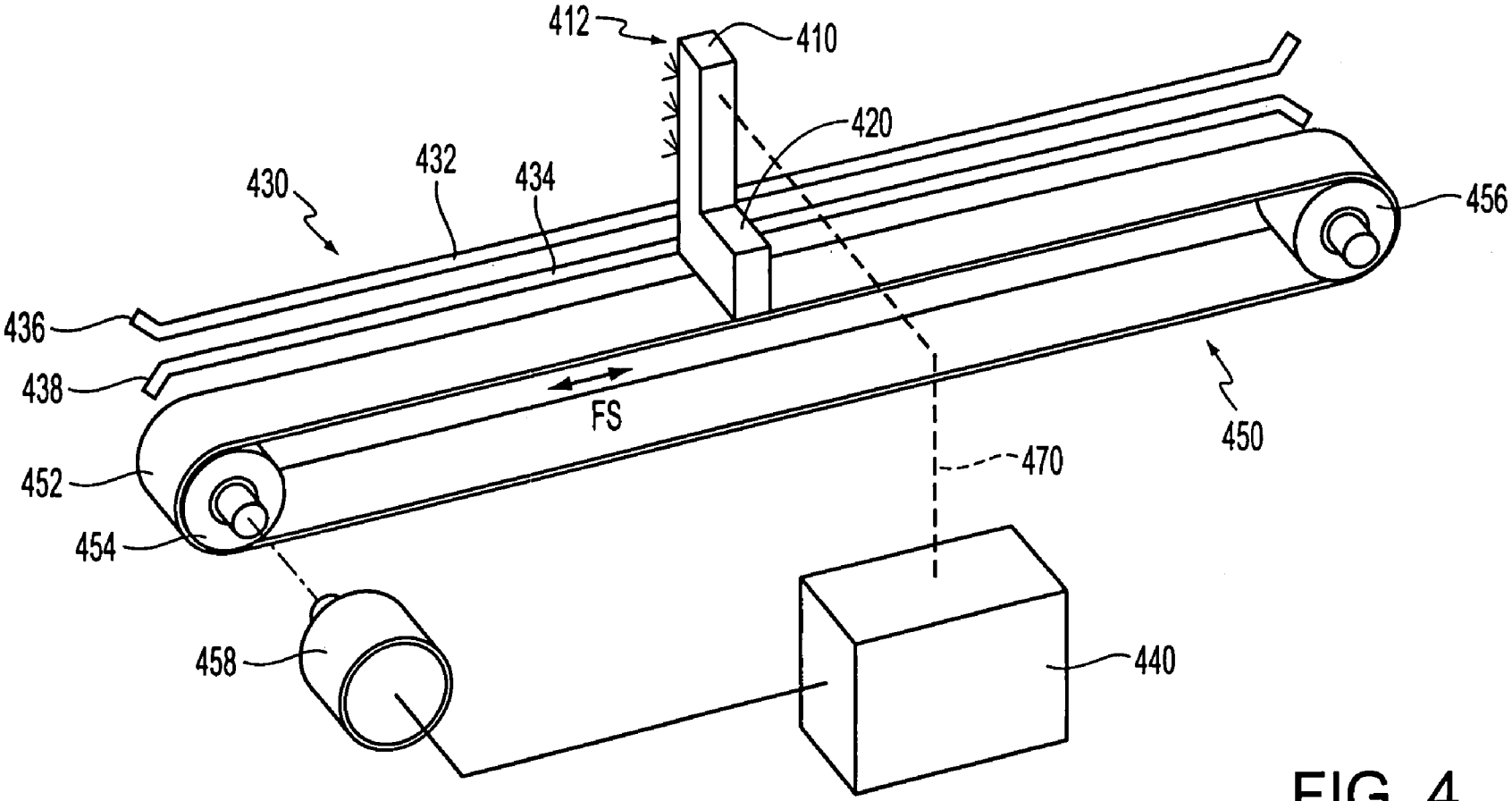
FIG. 4 shows an exemplary embodiment of a printer architecture having an endless printhead path and a third exemplary printhead guide system according to the invention.

A third embodiment of an endless printhead architecture with a third exemplary printhead guide system according to the invention in shown in FIG. 4. In this embodiment, a drive assembly 450 includes an endless belt loop 452 rotatably mounted on drive roller 454 and idler roller 456. Drive roller 454 is driven by a suitable drive source 458, such as a stepper or servo motor suitably controlled by CPU/controller 440. Printhead carriage 420 is fixedly attached to endless drive belt 452 for movement therewith by suitable attachments. However, rather than limiting, movement to linear reciprocal movement, the printhead carriage 420 is mounted and constrained so as to be rotatable about the drive roller 454 and idler roller 456. As such, printhead carriage 420 and printhead 410 are movable in an oval pattern.

This embodiment differs from the previous embodiment primarily in use of an alternative printhead guide system. Rather than providing an oval guide mechanism as in prior embodiments, this embodiment provides two sets of spaced guide assemblies 430 that guide movement only in the fast scan direction FS, primarily only in the print zone region. The first assembly 430 is illustrated and includes first and second opposed and parallel bar members 432 and 434. The second assembly (unshown) would be the same, but located substantially in-line with the bottom of the endless belt instead of the top of the belt. As the printhead carriage traverses beyond the print zone and starts to rotate about an arcuate path, the printhead carriage 420 becomes decoupled from guide assembly 430 allowing it to freely rotate about roller 454 while still being constrained about endless belt 452. Once it traverses the roller and starts to move inline with the fast scan direction, printhead carriage 420 again come in contact with and is guided by the other guide assembly 430 (not shown) To assist in entry, both lateral ends 436, 438 of guide assembly members 432 and 434 may be flared or tapered so as to better assist in entry and guidance of printhead carriage 420 into the guide assembly 430. As with prior embodiments, the guide assemblies 430 are sized and shaped to receive a mating member (unshown) provided on printhead carriage 420. The mating member can take many forms, such as a fixed or rotating element as in prior embodiments.

Figure 5:
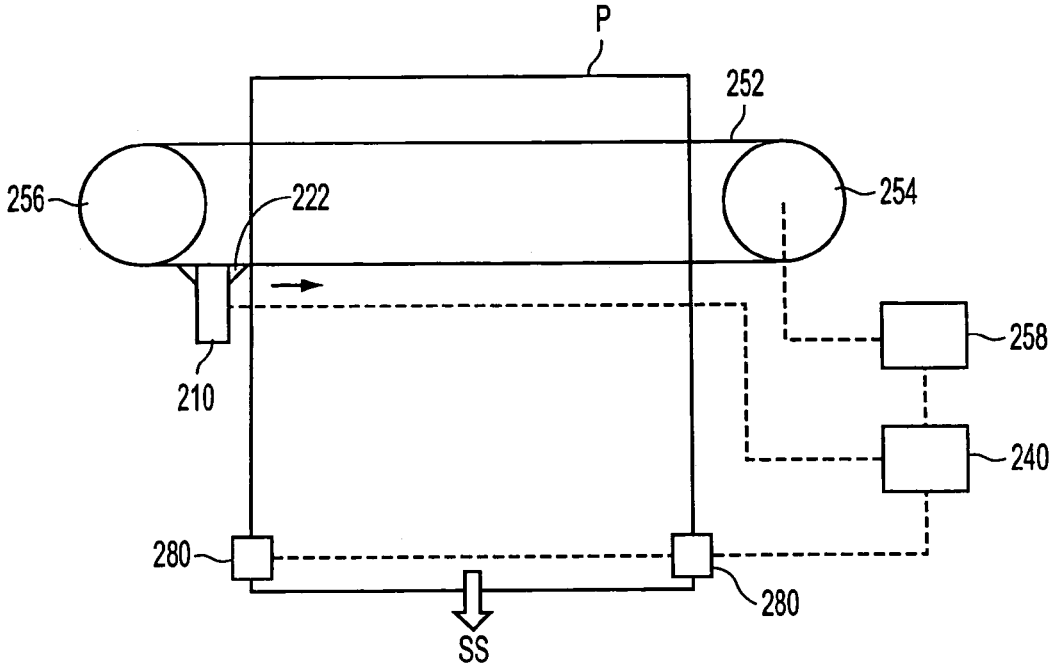
FIGS. 5–8 show representative schematic diagrams of a printer architecture having an endless printhead path showing the printhead in various stages of travel.
Figure 6:
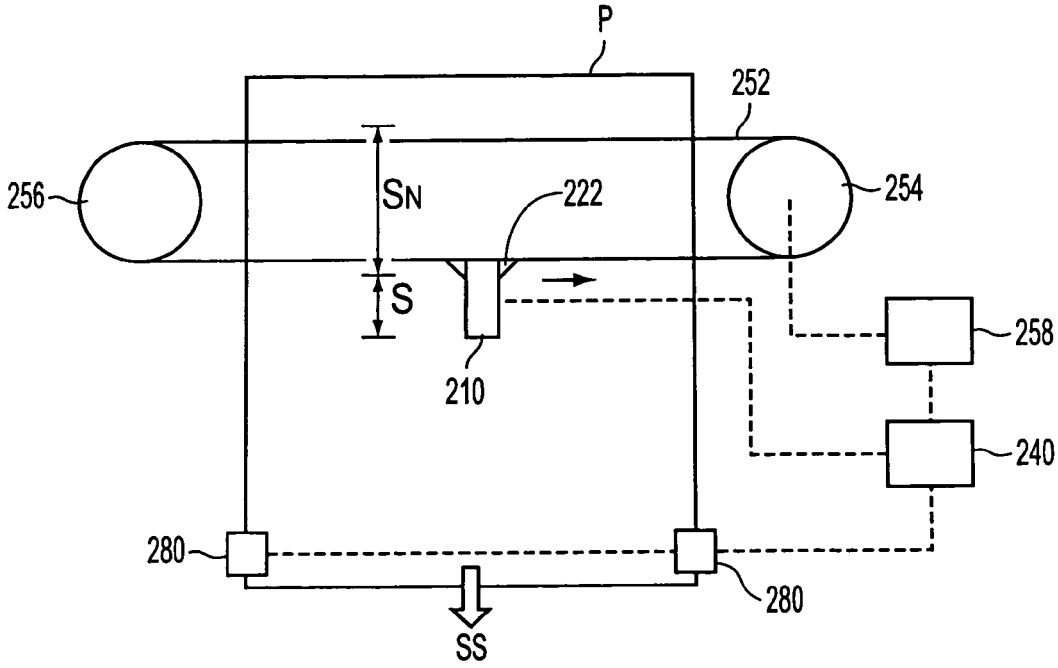
Figure 7:
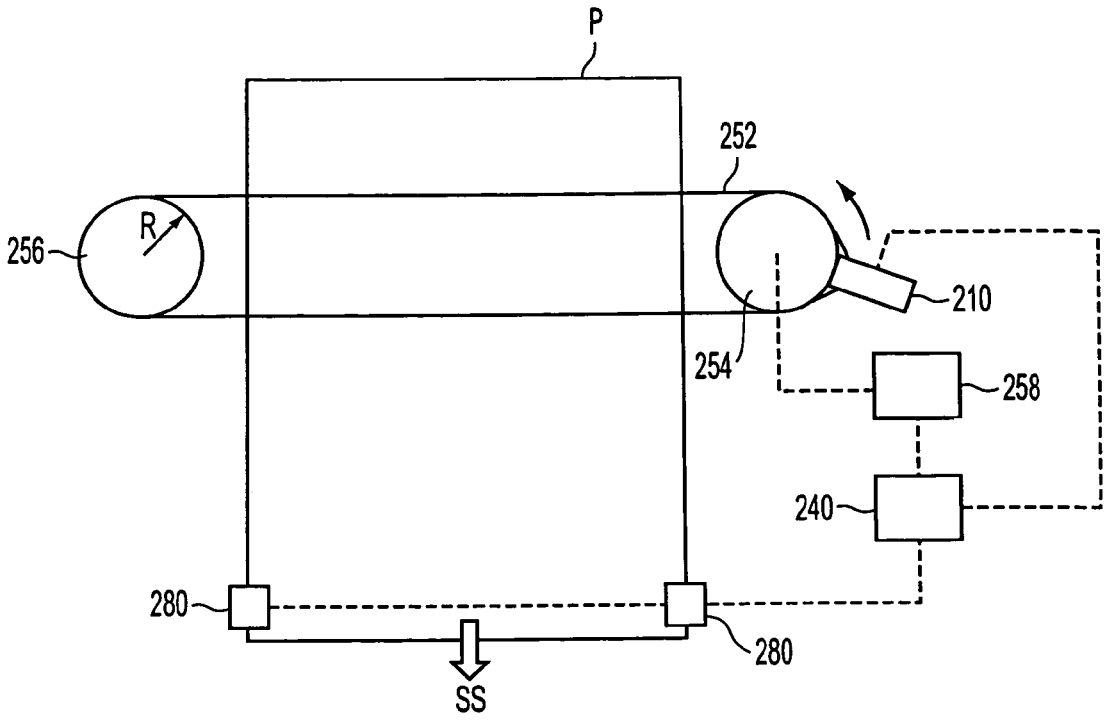
Figure 8:
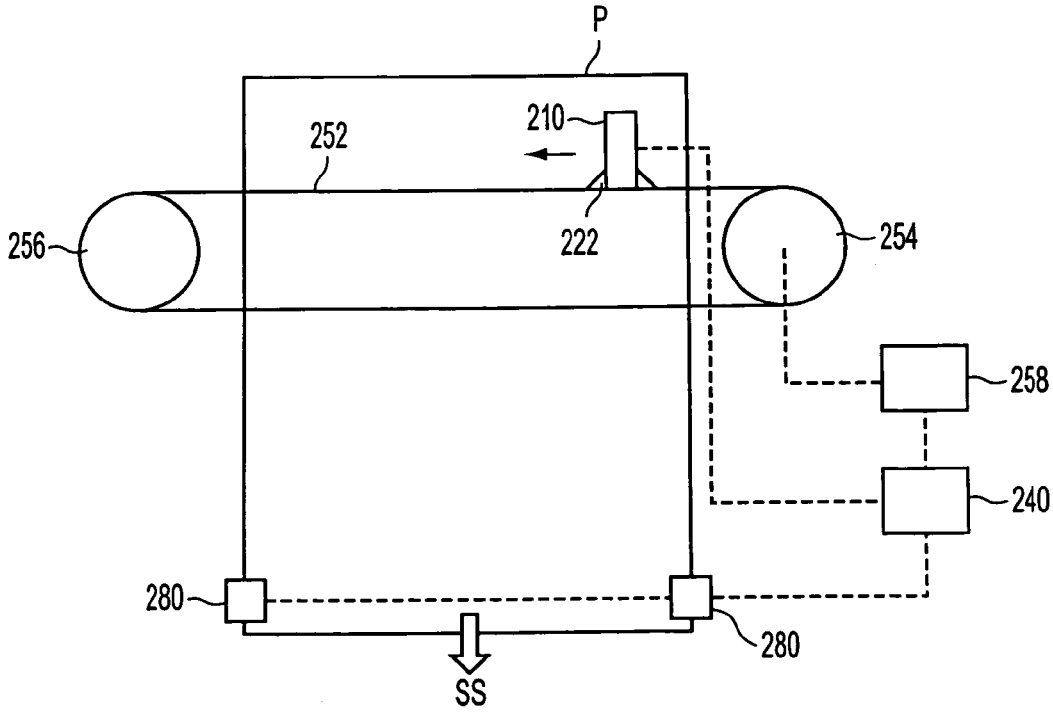

Operation of a printer architecture having an endless printhead path and printhead guide system according to an exemplary embodiment of the invention will be described with reference to FIGS. 5–8. FIG. 5 shows the printer architecture according to the first embodiment. However, it is equally applicable to any of the embodiments. As shown, a paper P is incrementally advanced across a printer assembly by driven rollers 280. At startup, the printhead 210 is provided at a non-print area outside of the print zone (defined by, for example, paper P as a simple illustration) as shown in FIG. 5. In a first endless loop mode, a start signal accelerates the printhead 210 to a suitable velocity when it reaches the print zone of the paper P to print a first swath of width S as shown in FIG. 6. Unlike reciprocal architectures that require deceleration and reacceleration, this architecture can remain with a substantially constant velocity once the end of the print zone is reached. Thus, rather than slowing, the printhead can rotate about the roller 254 on endless belt 252 as shown in FIG. 7, at which time the printhead 210 is rotated about the circumference of the roller 254 to again face the print zone while moving in an opposite direction as shown in FIG. 8. Then, upon reaching the end of the print zone, the printhead 210 can rotate about the other roller 256 where it returns back to the position shown in FIG. 5. With this configuration, endless path printing can be achieved with the printhead continually driven at a constant velocity in a same direction, such as the counterclockwise direction shown.

Figure 9:
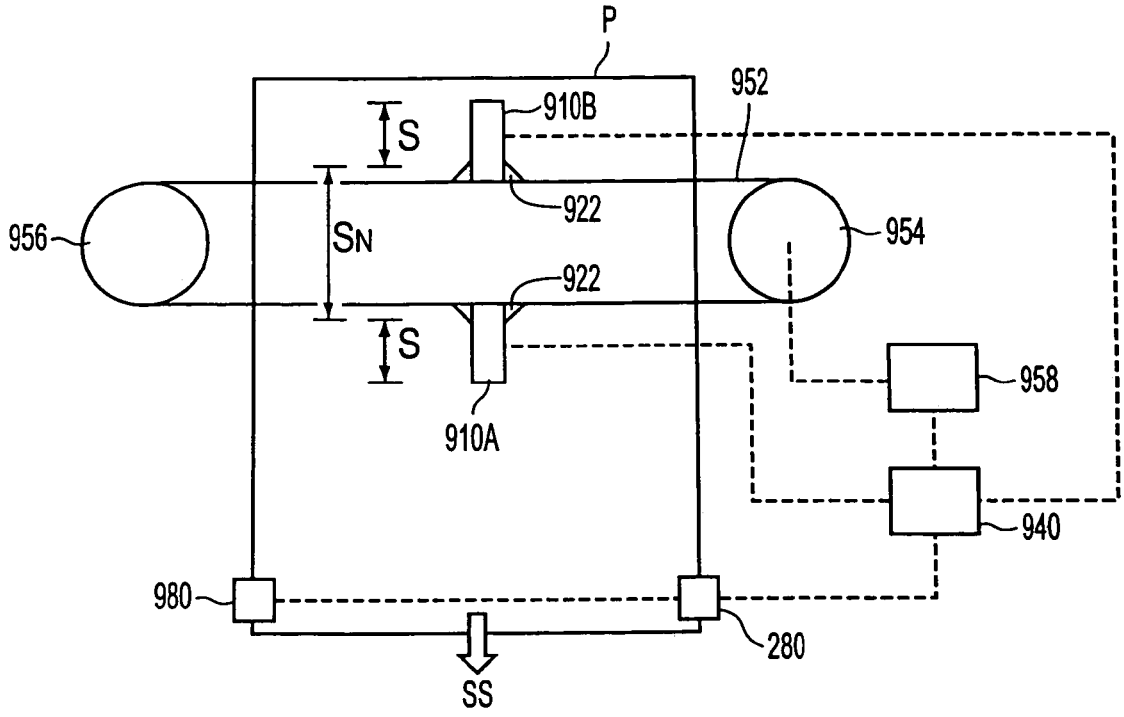
FIG. 9 shows an exemplary-embodiment of a printer architecture having an endless printhead path and multiple counter-balanced printheads according to the invention.

FIG. 9 shows an alternate embodiment where a counterbalance 910 of substantially the same mass as a printhead 910A is provided diametrically opposed to the printhead 910A to counterbalance the assembly and provide a more dynamically stable drive platform. In preferred embodiments, the counterbalance 910B may be another printhead. As in previous embodiments, the printheads 910A, 9101B are fixedly mounted on endless belt 952 by a mechanism 222. Endless belt 952 is mounted on drive roller 954 and idler roller 956. Drive roller 954 is driven by a suitable drive motor 958, which is controlled by controller 940, and also can control paper advance rollers 980. The oppositely placed second printhead also serves as a counterbalance, but further allows improved printer throughput and enhanced printing capabilities. These printheads may be of the same type and color or may be different colors or types. Moreover, although two heads are shown, more could be provided, preferably provided in balanced pairs. For example, one printhead may be black, while the other is a color head with one or more color components.

In this multiple printhead embodiment, further architectural advantages can be achieved that are not possible with conventional reciprocal architectures. For example, the standard architecture requires additional scan travel on both sides of the paper to compensate for the distance between the cartridges. This decreases throughput further by requiring longer non-print zones. It also increases the printer footprint dimensions as far as length goes. Other advantages are the ability to print directionally (both directions) or in a single pass mode. Also, since the color and black ink are spatially separated to print the same print swath in different print passes, additional drying time is allowed, which may reduce or eliminate intercolor bleeding or other image quality problems.

Further advantages over a reciprocal architecture is the ability to even further increase throughput without requiring an increase in print velocity. Given the prior example of an 8"×10" print zone with 1" swaths takes 10 passes in single pass mode. With a 1" radius drive, this corresponds to a turnaround time (non-print time) $t=(\pi/2)(1")/45=0.035$ seconds. Thus, total time to print this 8"×10" print zone=10 (8/45)+10(0.035)=2.13 seconds. In single pass mode this equates to 28.2 ppm. However, since both opposite heads print at the same time, but in opposite directions, one can achieve the effect of multipass or full color printing with substantially the same throughput as in single pass black mode.

Figure 10:
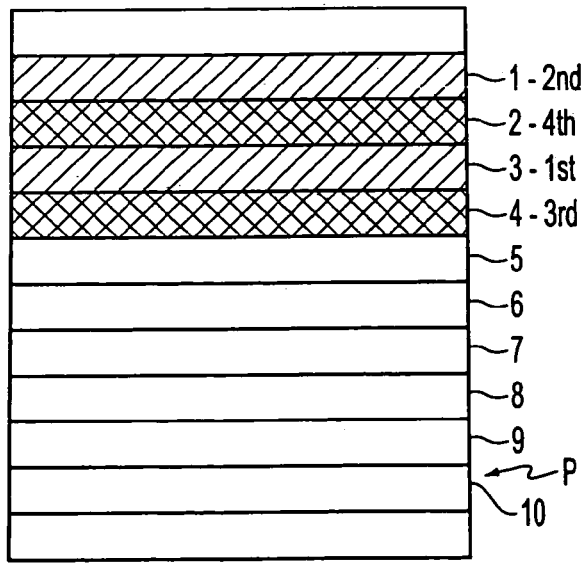
FIG. 10 illustrates an exemplary print swath printing scheme to print an 8½"×11" paper with a 1 inch print swath according to aspects of the invention.

In any of the embodiments of FIGS. 5–9, it is preferable that the pitch $S_N$ between consecutive passes is an integer multiple of printhead swath width S. This allows for ease in print swath processing and management. For example, in FIG. 10, there is shown an exemplary sheet of paper with 10-1" print swaths. One exemplary method of printing using an endless printhead path could print swath 3 in a first pass. Then, upon the printhead traversing around the diameter of the rollers, the printhead would print swath 1 second, which is transversely offset from swath 3 by an equal spacing. While the printhead is traversing around the roller in a non-print zone after the second pass, the paper indexing mechanism can index paper P by a distance corresponding to the swath spacing S. In this case, the index would be 1". Then, in a third pass, the swath 4 would be printed, followed by swath 2 in a fourth pass as shown. The process would then continue until the paper is completely printed. Obviously, other printing control schemes are attainable.

Another exemplary embodiment of endless loop printing using the multiple printhead configuration of FIG. 9 could be as follows. First the paper can be indexed and swaths 1 and 3 are simultaneously printed by the two opposing printheads in a first pass (½ rotation of the belt). Then, the paper P is indexed and swaths 2 and 4 are simultaneously printed, and so on. In various embodiments, by spacing the printing of the swaths, improved drying or other image quality improvements may be attained.

In various configurations of the exemplary embodiments of an endless loop printhead system, the printhead carriage is able to operate with unidirectional travel in one mode and reciprocal travel in another mode. It is also possible to operate in a composite mode in which multiple revolutions of travel in one direction are achieved, followed by one or more revolutions of travel in a second opposite direction. For example, when using the coiled wire connection shown in FIG. 2, it may be impossible to provide continuous movement in one direction without eventually twisting the coiled wire connection (similar to that which occurs in telephone cord connections). To avoid this, the printhead may operate for multiple iterations, such as printing of an entire page, with clockwise rotation. Then, for a subsequent page, the printhead can reverse its travel by moving counterclockwise for multiple iterations. This will have the effect of reversing the twisting.

In other various configurations of the exemplary embodiments of the printhead system, the printhead carriage movement does not have to be in endless loop fashion, but can be reciprocal. However, rather than traversing a purely linear path, the non-print zone can consist of at least a portion of the arcuate printhead carriage path around one or both of the endless belt rollers. This may in certain configuration result in a reduced printer width, since the deceleration/acceleration zone can occur on an arcuate path, rather than in a straight linear line. However, improved footprint would depend on the profile of the printhead assembly which extends around the drive roller, as well as the drive roller dimensions.

In various exemplary embodiments of the invention, the coupling between the printhead carriage and the endless belt is small or hinged so as to accommodate movement around the arcuate roller surface.

In exemplary embodiments when endless loop operation is enabled, considerable printer throughput increases can be achieved by reducing the non-print time per swath.

Figure 11:
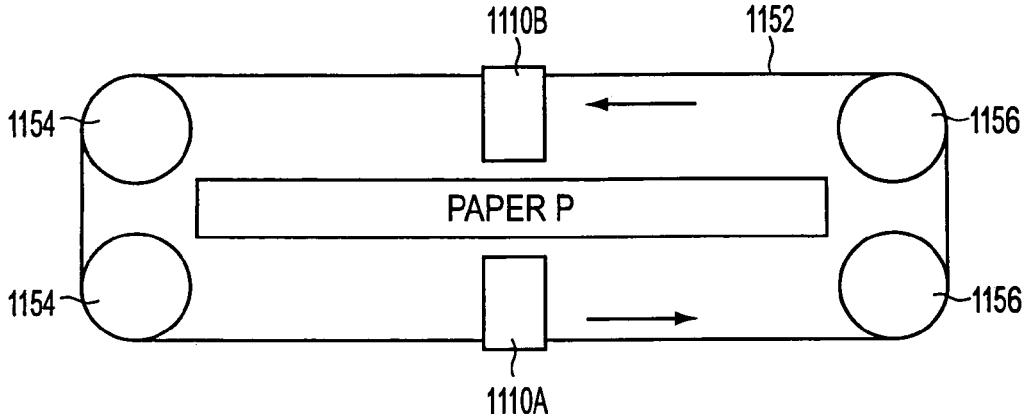
FIG. 11 illustrates a top partial view of another exemplary embodiment of a printer architecture having an endless printhead path that is capable of printing on both front and back sides of a sheet of paper.
Figure 12:
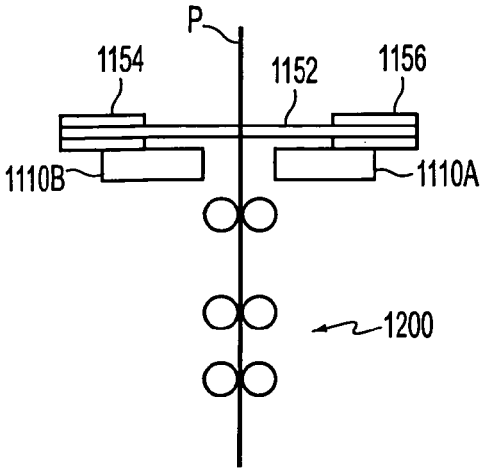
FIG. 12 illustrates a side view of the printer architecture of FIG. 11.

Another embodiment of the invention is shown in FIGS. 11–12, in which the architecture takes advantage of the capability of printing on both sides of the belt to achieve both side printing with the same throughput as single side printing in a single pass. This architecture differs from prior embodiments in that the printheads 1110A and 1110B are designed to face inward rather than outward. Additionally, the drive rollers 1154 and 1156 are sized or spaced to allow sufficient space within endless belt 1152 to receive an indexable sheet of paper P through the middle as shown in FIG. 11. Printing by the two printheads would thus occur simultaneously on opposite sides, with one printhead printing on one side during a first ½ pass, followed by printing of the opposite side during the subsequent ½ pass. Between passes the paper P can be indexed as known in the art by indexing system 1200 schematically represented.

Figure 13:
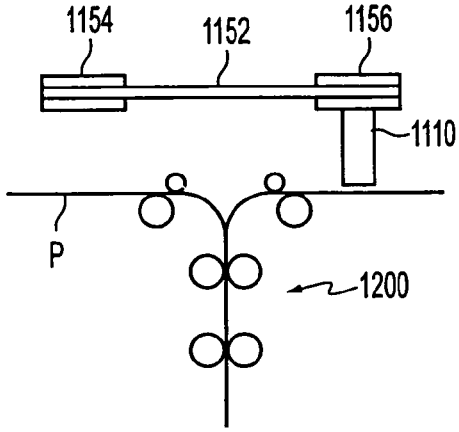
FIG. 13 illustrates a side view of yet a further embodiment of a printer architecture in which duplex printing is achieved according to aspects of the invention.

FIG. 13 shows a side profile of yet another embodiment in which the endless loop belt printing architecture can be used in a duplex arrangement. In this embodiment, paper P can be advanced through the indexing system 1200 in a first direction. Printhead 1110 in this embodiment is illustrated pointing downward toward paper, extending perpendicular to the endless belt 1152 and can then be driven to print on a first side of the paper P as in other embodiments. Then, upon completion of the first side printing, the paper can be inverted through an inverter portion of indexing system 1200. Now, the second side of the paper can be printed using the same printhead and unidirectional travel of the printhead.

It should be appreciated that this architecture may present some technical challenges in the areas of paper advance, carriage and printhead resolution, electrical connection and image processing control. However, such issues have been addressed in the various exemplary embodiments and has been found to be solved. As such, although certain of these technical challenges may increase the cost and complexity of the printer, the potential for increased throughput compared to conventional reciprocal architectures justifies the expense.

While this invention has been described in conjunction with the exemplary embodiments outlined above, various alternatives, modifications, variations, and/or improvements, whether known or that are, or may be, presently unforeseen, may become apparent. Accordingly, the exemplary embodiments of the invention, as set forth above, are intended to be illustrative, not limiting. Various changes may be made without departing from the spirit and/or scope of the invention. Therefore, the systems, methods, structures and/or devices according to this invention are intended to embrace all known, or later-developed alternatives, modifications, variations, and/or improvements.

What is claimed is:

1. A drive assembly for a printhead, comprising:

at least two spaced rollers, each rotatable about a central axis, at least one of which is a driven roller;

an endless drive belt loop connected between said at least two spaced rollers for rotation thereabout to define an endless loop drive path;

a drive mechanism that drives the endless drive belt loop in at least a first direction;

a printhead assembly including at least one printhead and carriage operably connected to the endless drive belt loop for movement therewith;

a guide assembly that constrains movement of the printhead assembly, the guide assembly being configured to allow movement of the printhead around both linear and arcuate portions of the endless loop drive path; and a controller that controls the drive assembly to traverse the printhead assembly over at least one-half the length of the endless drive belt loop to advance the printhead across a linear print zone and an arcuate non-print zone with a predetermined drive profile, wherein the central axes are essentially orthogonal to a recording medium path.

2. The drive assembly according to claim 1, wherein the controller controls the drive assembly to rotate the printhead assembly in a unidirectional endless loop mode in which at least one full revolution of the endless loop drive path is traversed by the printhead assembly.

3. The drive assembly according to claim 2, wherein the controller controls the drive assembly to advance the printhead assembly across the linear print zone at a substantially constant velocity.

4. The drive assembly according to claim 3, wherein the controller controls the drive assembly to advance the printhead assembly across the arcuate non-print zone at the same substantially constant velocity.

5. The drive assembly according to claim 1, wherein the endless loop drive path consists of two linear print zones disposed on the same side of the recording medium and two arcuate non-print zones defined by one-half the circumference of the spaced rollers.

6. The drive assembly according to claim 5, wherein the spaced rollers have a radius R of between about 15 and 50 mm to define a turnaround zone of length $\pi R$.

7. The drive assembly according to claim 1, wherein the at least one printhead includes at least two printheads diametrically opposed to one another on the endless loop drive path.

8. The drive assembly according to claim 1, wherein the guide assembly constrains movement of the printhead assembly in at least the linear print zone.

9. The drive assembly according to claim 1, wherein the controller controls the drive mechanism to also operate in a second direction opposite the first direction.

10. A printer comprising the drive assembly of claim 1 and an indexing mechanism to advance a recording medium past the printhead.

11. A printer having an endless loop drive path, comprising:

a drive assembly including at least two spaced rollers, each rotatable about a central axis, at least one of which is a driven roller;

an endless drive belt loop connected between said at least two spaced rollers for rotation thereabout to define an endless loop drive path; and a drive mechanism that drives the endless drive belt loop in at least a first direction;

a printhead assembly including at least one printhead and carriage operably connected to the endless drive belt loop for movement therewith;

a guide assembly that constrains movement of the printhead assembly, the guide assembly being configured to allow movement of the printhead around both linear and arcuate portions of the endless loop drive path;

an indexing mechanism to advance a recording medium past the printhead along a recording medium path; and a controller that controls the drive assembly to traverse the printhead assembly over at least one-half the length of the endless drive belt loop to advance the printhead across a linear print zone and an arcuate non-print zone with a predetermined drive profile and controls the indexing mechanism to advance the recording medium while the printhead is in the arcuate non-print zone, wherein the central axes are essentially orthogonal to the recording medium path.

12. The printer according to claim 11, wherein the controller controls the drive assembly to rotate the printhead assembly in a unidirectional endless loop mode in which at least one full revolution of the endless loop drive path is traversed by the printhead assembly.

13. The printer according to claim 12, wherein the controller controls the drive assembly to advance the printhead assembly across the linear print zone at a substantially constant velocity.

14. The printer according to claim 13, wherein the controller controls the drive assembly to advance the printhead assembly across the arcuate non-print zone at the same substantially constant velocity.

15. The printer according to claim 11, wherein the endless loop drive path consists of two linear print zones disposed on the same side of the recording medium and two arcuate non-print zones defined by one-half the circumference of the spaced rollers, the printhead having a print swath of a width S measured transverse to the first direction, and the two linear print zones being separated by a spacing $S_N$, where N is an integer multiple of S.

16. The printer according to claim 11, wherein the at least one printhead includes at least two printheads diametrically opposed to one another on the same endless loop drive path.

17. The printer according to claim 16, wherein the at least two printheads operate simultaneously to provide two offset print swaths separated by a predefined spacing.

18. The printer according to claim 11, wherein the guide assembly constrains movement of the printhead assembly in at least the linear print zone.

19. The printer according to claim 11, wherein the controller controls the drive mechanism to also operate in a second direction opposite the first direction.

20. The printer according to claim 11, further comprising a duplexer that reverses an orientation of the recording medium so that both sides of the recording medium can be printed.

21. A printer having an endless loop drive path, comprising:

a drive assembly including at least two spaced rollers, each rotatable about a central axis, at least one of which is a driven roller;

a single endless drive belt loop connected between said at least two spaced rollers for rotation thereabout to define an endless loop drive path;

a drive mechanism that drives the single endless drive belt loop in at least a first direction;

a printhead assembly including at least two printheads and carriages operably connected to the single endless drive belt loop for movement therewith, the at least two printheads being diametrically opposed to one another on the single endless loop drive path;

a guide assembly that constrains movement of the printhead assembly, the guide assembly being configured to allow movement of the printhead around both linear and arcuate portions of the single endless loop drive path;

an indexing mechanism to advance a recording medium in a path in a direction transverse to the first direction and through a center of the single endless loop drive path; and a controller that controls the drive assembly to traverse the printhead assembly over at least one-half the length of the single endless drive belt loop to advance the printheads across a linear print zone and an arcuate non-print zone with a predetermined drive profile and controls the indexing mechanism to advance the recording medium while the printheads are in the arcuate non-print zone, wherein the at least two printheads each face toward the recording medium so as to be capable of simultaneous both side printing.

* * * * *